United States Patent [19]

Langsetmo et al.

[11] Patent Number: 4,810,099

[45] Date of Patent: Mar. 7, 1989

[54] MIXER

[75] Inventors: Peder K. Langsetmo; Masayuki Inoue; Robert A. Douglas; Peter M. Koenig, all of Minneapolis, Minn.; Alex Halasz, Sebastopol, Calif.

[73] Assignee: Berwind Corporation, Philadelphia, Pa.

[21] Appl. No.: 57,300

[22] Filed: May 6, 1987

[51] Int. Cl.[4] ..... B01F 7/04

[52] U.S. Cl. ..... 366/168; 366/275; 366/326

[58] Field of Search ..... 366/64–67, 366/97, 98, 154–156, 167–169, 168, 173, 177, 275, 279, 285, 286, 325, 326, 328, 329, 341

[56] References Cited

U.S. PATENT DOCUMENTS

| | | | |
|---|---|---|---|
| 3,090,606 | 5/1963 | Burnet | 366/326 |
| 3,486,705 | 12/1969 | Szegvari | 366/168 |
| 3,650,510 | 3/1972 | Ansel | 366/325 |
| 3,656,716 | 4/1972 | Ljungerg et al. | 366/275 |
| 3,887,166 | 6/1975 | Van Ginnekan | 366/326 |
| 4,171,165 | 10/1979 | Card | 366/325 |
| 4,212,547 | 7/1980 | Thomson | 366/325 |
| 4,281,934 | 8/1981 | Krause et al. | 366/66 |

*Primary Examiner*—Timothy F. Simone
*Attorney, Agent, or Firm*—James P. Ryther

[57] ABSTRACT

A mixer includes an elongated flexible sleeve that is supported in a housing in a vertical orientation and has a mixing shaft extending therein with a plurality of blade holders supported on the shaft and each blade holder supports a plurality of blades. A deforming means extends around the flexible sleeve and is rotatable about a vertical axis by suitable reciprocating or rotating drive members to prevent accumulation of materials on the inner surface of the sleeve. The blade holders are preferably formed as an integral part of a mixing apparatus and each mixing blade is preferably individually supported on a holder to be infinitely adjustable and effect the mixing capabilities of the assembly. The flexible sleeve can be tensioned between upper and lower ends.

32 Claims, 6 Drawing Sheets

10
12
14
16
58
60
120
122
125
130
132
134
136
140
142
144
146
148
150
152
154
156
A

MIXER

DESCRIPTION

1. Technical Field

The present invention relates generally to mixing apparatus and, more particularly, to apparatus that is designed to form a granular material from a powder mixture.

2. Background Prior Art

Various types of mixers have been proposed for converting a powder-type material into a granular substance that has a generally uniform condition. For example, U.S. Pat. No. 3,887,166 discloses a mixer that has a generally elongated, substantially cylindrical upright flexible sleeve which forms a mixing chamber that receives a supply of solid material and a supply of liquid that is mixed to form granules. The mixer disclosed in this patent consists of a driven mixing shaft that has a plurality of blade holders supported thereon with each of the blade holders supporting a plurality of mixing blades. The mixer is designed to be tilted with respect to the vertical axis and has a deforming means which surrounds the flexible sleeve to deform the wall thereof, thereby breaking up encrusted materials that are formed on the inner surface.

The specific embodiment illustrated has a deforming means which is in the form of a plurality of groups of rollers that extend perpendicular to the axis of the sleeve and each group is circumferentially spaced around the perimeter of the sleeve. The groups of rollers are axially reciprocated to deform the sleeve in the generally circumferential direction.

Mixers of this kind are usually utilized in a continuous operation wherein a powdered solid material and a liquid are introduced into the upper end of the mixing chamber and the respective blades on the blade holders are positioned and designed to maximize the formation of granular material from the powder or particulate material that is introduced into the chamber. As is well known, competitors are constantly striving to increase the productivity of their units, as well as the efficiency of operation while reducing the costs of construction.

SUMMARY OF THE INVENTION

According to the present invention, a mixer includes a flexible, substantially circular sleeve that defines an elongated mixing chamber which is supported on a fixed vertical axis and has a solid material supply inlet and a liquid supply inlet at the upper end thereof. A mixing shaft is coupled to a drive and extends into the mixing chamber with a plurality of mixing blades supported thereon.

The mixer includes a deforming means which may take the form of a substantially-circular cage which surrounds the sleeve and has a plurality of circumferentially-spaced, axially-extending rollers freely rotatable thereon. The cage is supported for rotation around the vertical axis of the sleeve to deform the wall of the sleeve and break up deposits formed on the inner surface thereof.

According to one aspect of the present invention, the circumferentially spaced rollers are independently adjustable in the radial direction on the cage to thereby accurately control the position of the rollers with respect to the sleeve. In one embodiment of the invention, the surrounding cage is suspended by guide rollers adjacent the upper end of the sleeve and is driven by a drive means that continuously rotates the cage around the periphery of the sleeve. In an alternate embodiment, the cage is supported adjacent the lower end of the sleeve by circumferentially spaced guide rollers and the drive means includes a fluid cylinder that reciprocates the cage between arcuate predetermined limits around the perimeter of the fixed sleeve.

According to one aspect of the present invention, the upper end of the sleeve is releasably clamped to the housing and is suspended therefrom, being held at the lower end by a gripping means. In another version, the bottom of the sleeve is free to move axially and is prevented from relative movement on the housing so that the weight thereof maintains the sleeve in a vertical orientation.

The aforementioned roller cage may be used with all sleeve configurations, however, other types of deforming means are also contemplated. In accordance with one variation wherein the upper or lower end of the sleeve is held stationary, the opposite end is connected to a reciprocating means adapted to impart a twist to the sleeve to achieve deformation. Alternatively, the sleeve may be held stationary at the top and bottom and a ring tied near the center of the sleeve. By reciprocating the ring, the sleeve is twisted to achieve deformation. In accordance with another alternative, the gripping means at the lower end are connected to axially-movable reciprocating means which will alternatively stretch and compress the sleeve.

The sleeve itself may be designed to enhance the deformation function. Specifically, a rubber sleeve or the like may include a cord reinforcement with the cords lying at an angle to the sleeve axis. The degree of deformation can then be varried depending on the angle assumed by the cords. This arrangement would be particularly useful where a stretching or twisting mechanism is used.

According to one aspect of the present invention, the upper end of the sleeve is releasably clamped to the housing and is suspended therefrom, being held at the lower end by a gripping means. In one embodiment, the gripping means is biased downwardly by a drive cylinder means to thereby stretch the sleeve between the upper and lower ends thereof. In another version, the bottom of the sleeve is free to move axially and is prevented from relative rotation on the housing so that the weight thereof maintains the sleeve in a vertical orientation. In a further alternative embodiment, the sleeve may be positively clamped at the lower end to the housing.

According to one further aspect of the present invention, the mixing means supported on the mixing shaft includes a plurality of axially spaced blade holders which may be formed integral with a hollow supporting member and each has a plurality of angularly related supporting surfaces formed thereon. In the specific embodiment, each blade holder has a first circumferential supporting surface that extends axially of the mixing shaft and two angularly inwardly inclined supporting surfaces at opposite ends of the circumferential surface, with each of the three supporting surfaces having a plurality of circumferentially spaced blade supporting bores formed therein.

Various types of holding and locking means may be utilized and in the preferred form illustrated herein, each blade consists of a circular base that has an integrally formed flattened end. The base is received into a supporting bore with releasable retaining means for supporting the blade in the bore.

In one form, the releasable retaining means includes a hollow threaded nut which surrounds the base of the blade and is received into the bore.

More specifically, the base may be externally threaded and the retaining means may be in the form of a hollow internally threaded lock nut received onto the threaded base and having a peripheral tapered locking surface that engages with a corresponding locking surface defined on the tool holder around the bore. The threaded base is received into the bore, which has a corresponding thread, so that the flattened end can be infinitely angularly and axially adjustable with respect to the tool holder.

In another version, the locking nut is externally threaded and cooperates with an internal thread in the bore and telescopicly receives the base of the blade. A split locking ring is located at the bottom of the bore surrounding the base so that the base is compressed against the bottom of the bore by the split locking ring as the latter is engaged by the locking nut. In a further modified form, each base of the blades has an annular groove which receives the free end of a threaded set screw that is received into an opening on the tool holder to frictionally lock the blade in an angular adjusted position within the bore.

BRIEF DESCRIPTION OF SEVERAL VIEWS OF DRAWINGS

DETAILED DESCRIPTION

Figures 1, 3, 3A:
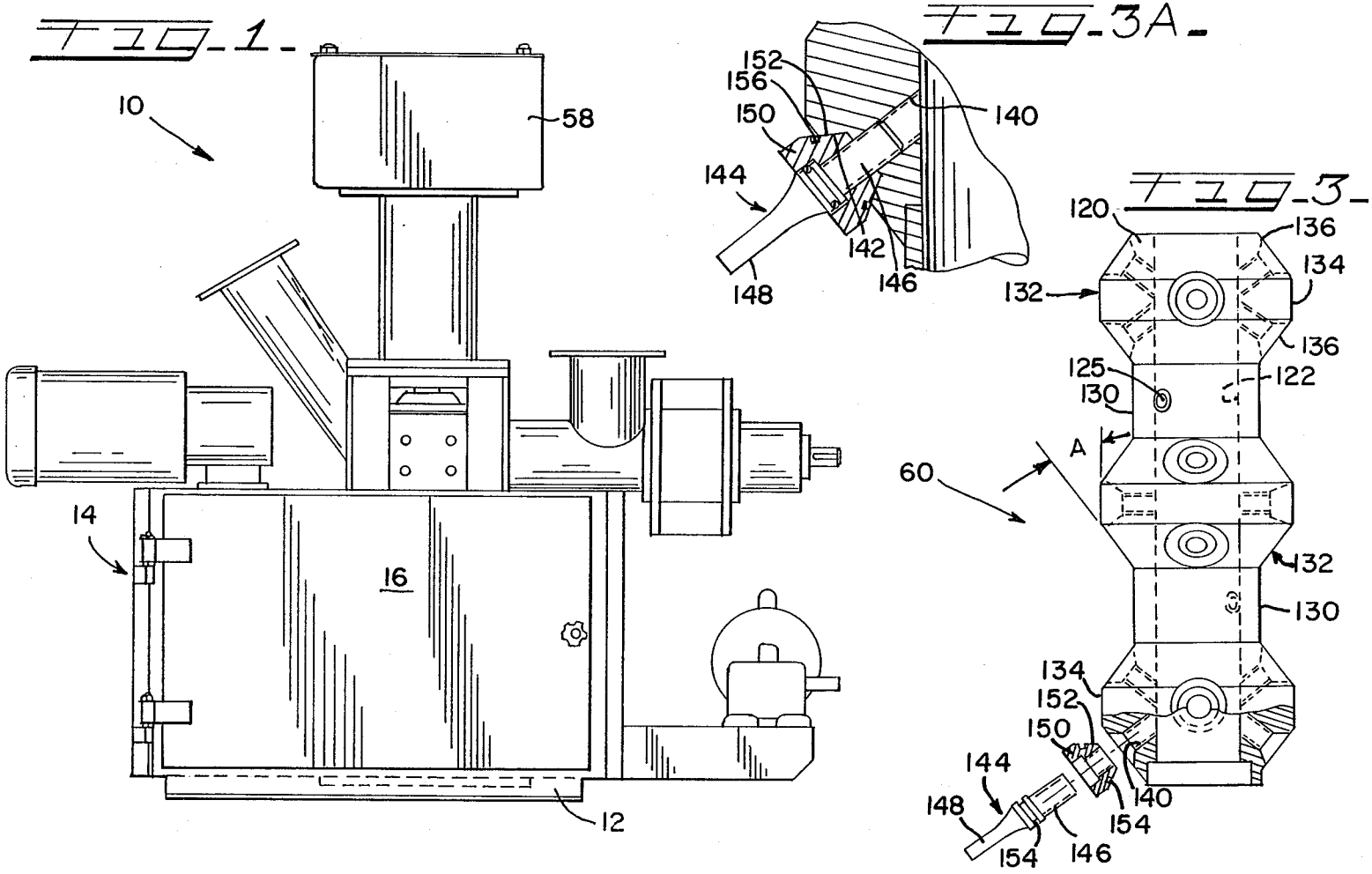
FIG. 1 is a side elevational view of the mixer having the features of the present invention incorporated therein.
FIG. 3 is a side view of an integrally formed mixing member that supports a plurality of mixing blades.
FIG. 3A is an enlarged fragmentary cross-sectional view showing the details of a mixing blade and its securing means.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspects of the invention to embodiments illustrated.

FIG. 1 of the drawings discloses a mixer generally designated by reference numeral 10 that includes a base 12 which supports a housing 14 that has a door 16 located on one side for gaining access to the interior.

Figures 2, 4, 5A:
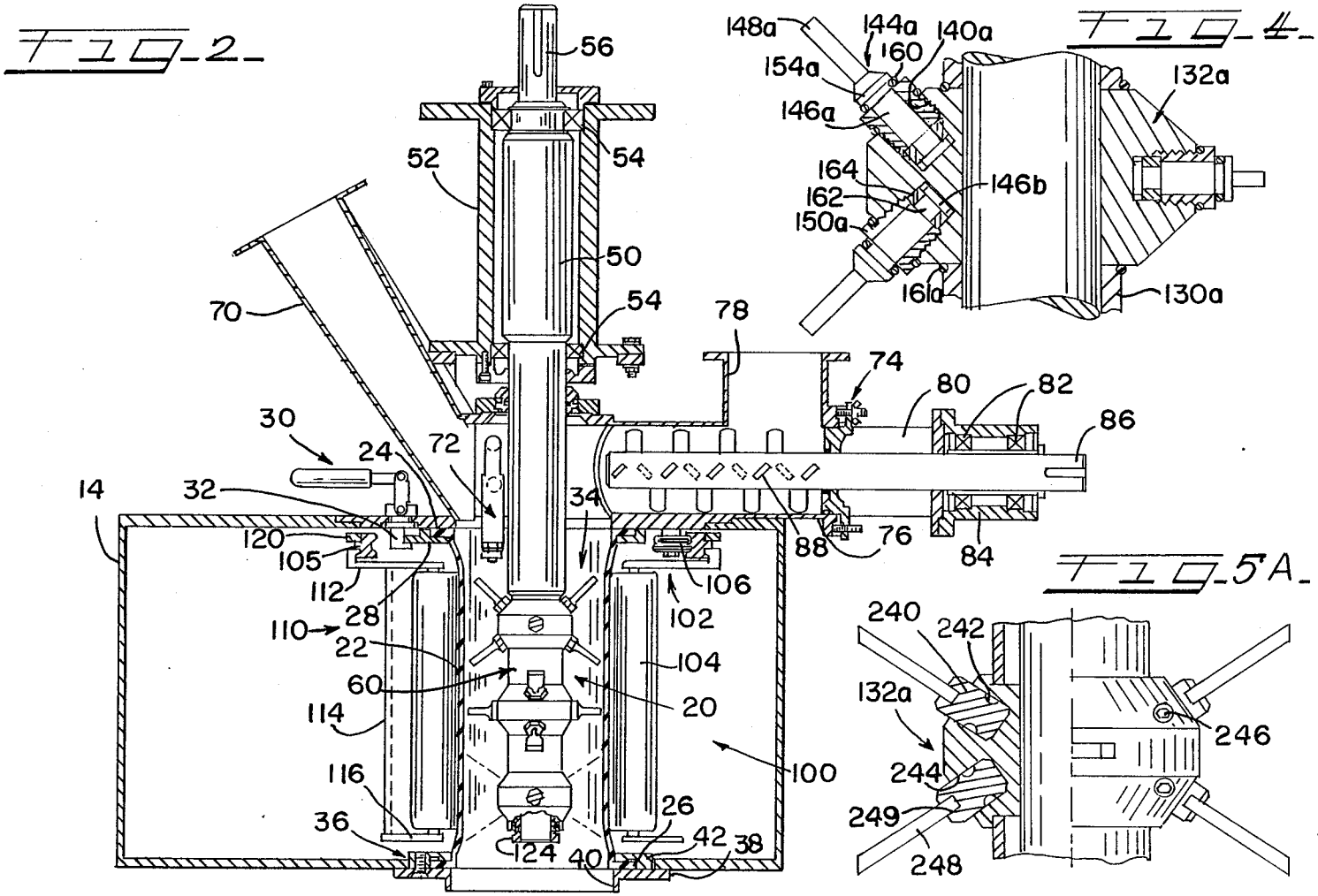
FIG. 2 is an enlarged cross-sectional view showing the internal construction of the mixer.
FIG. 4 is a fragmentary cross-sectional view showing an alternative form of retaining means for the blades on the blade holder.
FIG. 5A is an enlarged fragmentary sectional view similar to FIG. 4 showing a further type of securing means for the blade.

As disclosed in FIG. 2, the housing 14 encloses a mixing chamber 20 which is defined by a generally circular vertically extending sleeve 22 that is preferably formed from a flexible material, such as rubber. The sleeve 22 has an outwardly directed flange 24 adjacent the upper end and an outwardly directed flange 26 at the lower end. The upper outwardly directed flange 24 is secured to housing 14 by a clamping ring 28 and a clamping means 30 carried by the housing 14. The clamping means includes an L-shaped gripping element 32 and a collar 31 rotatable in an opening in the housing with a handle 33 pivoted on the collar and having a camming member thereon. The clamping means is thus releasable and the collar rotated to release the clamping ring 28. Two or more such clamping means 30 may be utilized around the perimeter of the flange 24 to fixedly secure the upper end of the sleeve 22 in the position surrounding an upper opening or inlet 34 defined in the housing.

The lower outwardly directed flange 26 also has a clamping means 36 which includes a lower member 38 that has a circular opening 40 defined therein and aligned with the axis of the sleeve 22 to define an outlet for the mixing chamber 20. The clamping means 36 also includes a second flange or gripping member 42. The members 38 and 42 are interconnected through a plurality of circumferentially spaced connecting means 44.

In the embodiment illustrated in FIG. 2, the clamping or gripping means 36 is free of the surrounding housing 14 so that the entire sleeve 22 is suspended by clamping means 30 cooperating with the flange 24. While not shown specifically in FIG. 2, the lower gripping means 36 may have a cooperating element which limits the clamping element and thus the sleeve to axial movement and prevents any rotational movement, as will be explained later. By way of example and not of limitation, the housing 14 and the gripping means 36 could have a tongue and groove arrangement that would accommodate axial movement but would prevent any rotational movement, as is known in the art.

A mixing shaft 50 is supported at its upper end on circular extension 52 defining part of the housing 14 with suitable bearing means 54 interposed between the extension 52 and the shaft 50. The upper end of the shaft 50 may have a coupling 56 forming a part thereof which may be coupled to any suitable drive means 58 (FIG. 1) as is well known in the art. The lower end of the shaft 50 has a reduced portion which is located within the mixing chamber 20 and supports a mixing member that is generally designated by reference numeral 60. The details of the mixing member 60 will be described in detail later.

A first powder or particulate material supply inlet 70 is upwardly and outwardly inclined from the extension 52 and has a lower opening leading to the upper inlet the mixing chamber 20 to supply particulate material to the chamber, as will become apparent later. Likewise, the mixer has a liquid supply means 72 located adjacent the upper inlet to the mixing chamber 20 and the details thereof will be described later.

According to one aspect of the present invention, the particulate supply inlet preferably incorporates two different types of supply means and the second supply means 74 is illustrated in detail in FIG. 2. The second supply means or inlet consists of a substantially circular tube 76 that extends substantially perpendicular to the axis of the shaft 50 and the sleeve 22 and thus extends horizontally outwardly from the housing 14. The supply tube 76 has an upwardly opening inlet 78 for receiving the particulate material and has a material transporting or drive member 80 that is rotatably supported by bearings 82 on an extension 84 that may be considered part of the housing 14. The rotating shaft is driven by a suitable drive motor connected to a coupling 86 on the end of shaft 80.

The transporting shaft 80 has a plurality of groups of agitating paddles 88 that are circumferentially spaced about 90° around the shaft 80. Each of the agitating paddles is inclined at about a 45° angle with respect to the axis of the shaft 80 and the paddles in alternate groups are offset at 90°. Thus, rotation of the shaft will move the powdered or particulate material from the upper inlet 78 in through the upper inlet opening 34 leading into the mixing chamber 20. It has been found that the horizontal feed tube arrangement provides a very uniform supply of particulate material into the inlet which enhances the formation of the desired shape and size of the granules that are being formed in the mixing chamber. Of course, the alternate inlet or inclined tube feed means 70 could likewise be utilized for gravity feed of the powdered material or, in some instances, two different materials may be supplied for mixing in the chamber 20.

According to one of the primary aspects of the present invention, the mixer 10 incorporates a deforming means 100 for flexing or deforming the flexible sleeve 22 to prevent accumulation of materials on the inner surface thereof. As will be appreciated, the mixing chamber is designed especially for mixing a powdered material with a liquid or binder material, to produce granules or flakes of a predetermined size. Thus, the mixture tends to adhere to the inner surface of the mixing chamber defined by the sleeve 22.

In the specific embodiment illustrated in FIG. 2, the deforming means 100 consists of a substantially circular cage or arcuate support member 102 that extends at least partially around the sleeve 22 and has at least one deforming member 104 rotatably supported thereon. The arcuate support member includes a support ring 105 that is supported on a plurality of circumferentially spaced guide rollers 106 which are freely rotatable on the housing 14, one being illustrated in FIG. 2, but preferably three being equally spaced around the perimeter of the ring.

The ring or drive member 105 has a plurality of support brackets 110 circumferentially spaced thereon and the support brackets may take any particular configuration and could be in the form of a continuous ring if desired. Alternatively, the support brackets could be individual bracket structures having an upper bracket portion 112 fixedly secured to the ring 105 and having a depending portion 114 extending downwardly therefrom and an inwardly directed bracket 116. The forming members or rollers 104 are preferably supported for free rotation on the upper and lower brackets 112 and 116 and are positioned so that the centers of a plurality of rollers, preferably at least two in number, are located on a common axis. The inner edges of the rollers define a circular path that has a diameter less than the diameter of the freely supported sleeve 22. A drive means in the form of a drive gear 120 is secured to the support ring 105 and is in driving engagement with at least one drive sprocket or gear (not shown) supported on the housing.

Thus, the entire ring structure 105 and the associated gear 120 are continuously rotated in one direction around the perimeter of the sleeve 22. The rollers 104 will selectively deform the sleeve inwardly along a vertical plane and so as to break up any encrusted material adhering to the inner surface of the sleeve.

According to one further aspect of the present invention, the mixing member 60 supported on the mixing shaft 50 is of a special configuration and construction to maximize the mixing capability for the unit. Thus, as illustrated in FIG. 3, the mixing apparatus 60 consists of a hollow tubular member 120 that has a central circular opening 122 therethrough which receives the lower reduced diameter portion of the mixing shaft 50 and is secured thereto by suitable retaining means 124 (FIG. 2). If desired, liquid may be delivered to the interior of member 120 and ejected through nozzles 125.

The member 120 may be a unitary solid one-piece structure that has axially spaced reduced diameter portions 130 which produce integrally formed blade holders 132 at opposite ends thereof, three being illustrated in the embodiment shown in FIG. 3. The blade holders may also be individually formed and spaced apart by means of cylindrical spacers. The integrally-formed blade holders are preferred when there are sanitation requirements and in other cases where ease of cleaning is important. Each blade holder is preferably substantially identical in construction and consists of an enlarged portion that defines a first circumferential substantially circular supporting surface 134 that extends around the perimeter of the member 120 and has its axis coincident with the axis of opening 122. Second and third circumferential tapered support surfaces 136 are located on opposite ends of the circumferential supporting surface 134, as clearly illustrated in FIG. 3. The tapered supporting surfaces 136 preferably define an angle A with respect to the circumferential surface 134 which positions the mixing blades in a desired angular orientation, as will be described later.

Each of the supporting surfaces 134, 136 has a plurality of circumferentially spaced bores 140 defined therein. In the preferred embodiment, the bores 140 extend perpendicular to each of the surfaces 134, 136 and have enlarged outer end tapered portions 142, as will become apparent later. The bores 140 are all internally threaded and are designed to receive individual mixing blades 144, one of which is illustrated in detail in FIG. 3A. Thus, each mixing blade consists of a one-piece member that has a generally circular threaded base 146 and an outwardly flared or flattened portion 148 that defines an elongated mixing blade. A retaining means or hollow lock nut 150 is internally threaded and is received onto the threaded base 146. The external surface of the lock nut 150 has a taper 152 which corresponds to the taper of a counterbore 142 on the outer end of the bore 140. The lock nut and the blade may have suitable grooves 154 formed therein which receive O-rings 156 for sealing purposes.

In the assembly of the blades 144 onto the blade holders 132, the lock nuts 150 are initially threaded onto the bases 146 and the bases are then threaded into the bores 140. When the blade 148 is in the desired axial and radial position, the lock nut is then manipulated to produce frictional engagement with the tapered surface 142 to frictionally lock the blade in an angular, as well as a predetermined axially oriented, position with respect to the supporting shaft 50. O-rings 156 are utilized for purposes of sealing-off access of material being treated to threads and other crevices which characterize these parts. This arrangement facilitates cleaning of the parts which are particularly important where sanitary conditions must be maintained.

With the specific construction of the blade holder disclosed in FIG. 3, a plurality of mixing blades 144 will extend generally perpendicular to the axis of the mixing shaft 50 while a plurality of blades will have an upwardly and outwardly inclined angle with respect to the axis and the remainder of the blades will have a downwardly and outwardly directed angle. While not limited, the angle A is preferably on the order of about 35° and all of the bores in surfaces 136 are equally circumferentially spaced and extend perpendicular to the surfaces.

The particular construction has been found to maximize the mixing capacity for the material in that the upper set of mixing blades will have a tendency to move the material toward the axis of the mixing shaft, the perpendicular blades on the circumferential supporting surfaces 134 will tend to move the material outwardly while the lower sets of blades on supporting surface 136 will have a tendency to move the material downwardly and outwardly in the mixing chamber. The particular arrangement has been proven successful in maximizing the granulation of powdered material into substantially uniform granular size for the finished product.

A slightly modified form of retaining means for the respective blades is illustrated in FIG. 4 wherein each blade **144*a* has a circular base 146*a* that is received in a circular bore 140*a* which is internally threaded and receives the external thread of a hollow lock nut 150*a*. The base 146*a* has an annular groove 154*a* at its upper end which receives a sealing O-ring 160. The lower end of the base has a reduced diameter portion 162 which supports a split locking ring 164. Thus, the flat portion 148*a* of the blade 144 can be positioned at any desired angular orientation with respect to the axis of the bore 140*a*. The lock nut 150*a* is utilized to secure the blade 144*a* in the desired orientation relative to the bore by compressing the bottom 146*b* of the base 146*a* against the bottom of the bore 140*a* through the locking ring 164**.

As in the case of O-rings 156 (FIG. **3*a*), O-rings 160** serve a particularly valuable purpose where the equipment is involved in processes requiring stationary conditions. The O-rings avoid the collection of material in threads and other part crevices. Moreover, the parts are easier to clean when the O-rings are used since smooth surfaces are exposed to cleaning means used.

Additional O-rings 161 and **161*a* may be located beneath the shoulder defined by lock nuts 150*a*, and at the interface of spacer 130*a* and holders 132**, respectively. Similarly, O-rings can be located at the opposite ends of individual holders are integrally formed groups of holders which are simply supported on a shaft. In all cases, the O-rings facilitate the maintenance of sanitary conditions.

FIG. 4 also illustrates an embodiment of the invention wherein the holders **132*a* are formed as separate members and suitable spacers 130*a* are interposed between an adjacent pair of holders 132*a*. The holders and sleeves may be retained on the supporting shaft 50 through suitable retaining means 124*a*, illustrated in FIG. 5**.

Figure 5:
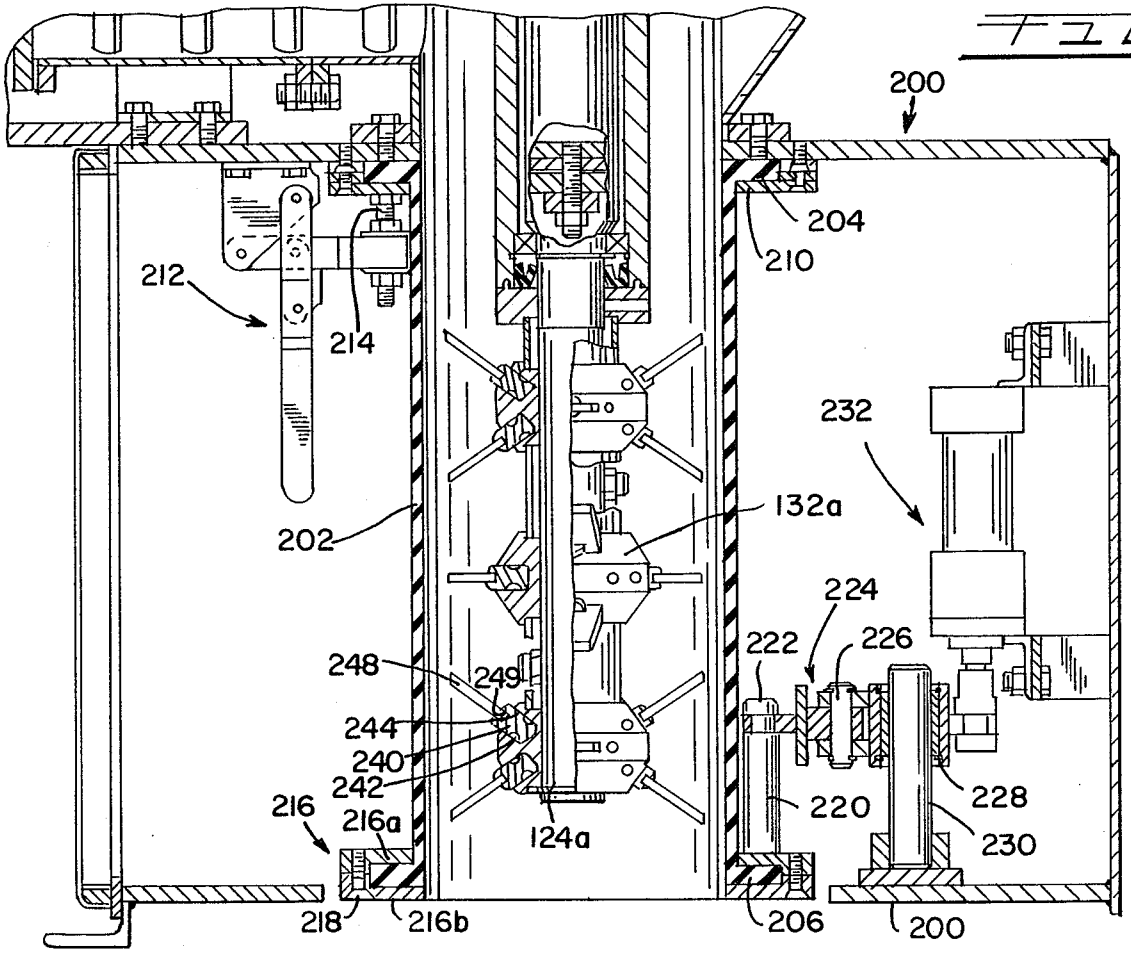
FIG. 5 is a cross-sectional view similar to FIG. 2 showing a slightly modified form of the present invention.

A modified form of mixer is disclosed in FIG. 5 and includes a housing 200 that has a sleeve 202 supported therein. The sleeve 202 has upper and lower outwardly directed flanges 204 and 206. The upper support flange 204 is clamped between a gripping member 210 and the housing 200 through suitable clamp means 212, only one being shown in FIG. 5, which has an adjustable clamping surface 214 formed thereon. In this embodiment, the support means suspends the sleeve within the housing by the upper clamped flange 204.

The lower flange 206 has a clamping member 216, consisting of upper and lower clamping elements **216*a* and 216*b* secured to each other by suitable screws 218. A plurality of hollow spacers 220 receive bolts 222 which are secured to upper clamp element 216*a*. One end of a connector 224 is supported between the head of bolt 222 and spacer 220 while the opposite end is rotatably supported on a pin 226 that forms part of a clevis 228. Clevis 228 is axially slidable on a support rod 230 that extends upwardly from the housing 200. A fluid ram 232 is secured to the housing 200 and has its piston rod connected to the clevis structure 228** by suitable means.

Thus, the fluid ram is used to alternatively compress and stretch the sleeve 202 in the axial direction to break-up the encrusted material. It should be noted that the lower clamping or gripping means 216 is located in an enlarged opening in the lower portion of the housing 200 so as to be totally unobstructed by the housing to allow axial movement of the sleeve.

Figure 10:
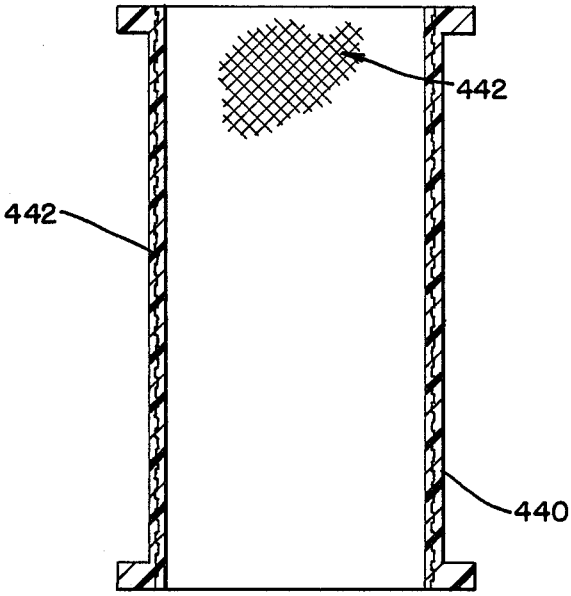

FIG. 10 illustrates a mixer sleeve 440 which is designed to achieve control of the amount of deformation. In this case, the sleeve is also formed of a flexible material, such as silicone rubber, and this material is reinforced with a glass fibre, stainless steel wire or other mesh having a higher modulus of elasticity than the rubber, and with the strands thereof extending at 45° angles to the sleeve axis. This angle may be varied depending on the amount of deformation desired with angles between 15° and 75° being contemplated. Thus, with the structure of FIG. 5, a particular type of sleeve may be selected, for example, because of the type of material to be handled by the mixer.

The sleeve of FIG. 10 may be used in conjunction with any of the embodiments previously or hereinafter described, although it is considered most useful in connection with the structure of FIGS. 5 and 9.

FIG. 5 also discloses a further modified form of locking means for the respective blades supported on the blade holders **132*a*. Thus, as illustrated in FIG. 5A, each blade consists of a substantially circular socket or base 240 that has a circular annular groove 242 defined on the periphery thereof, and is received into a bore 244. The base 240 is releasably retained in any angular position within the bore 244 by a set screw 246. The blade 248 may be a separately formed element that is received into a slot 249** defined on the outer end of the base. With this embodiment, the width and the length of the blade or paddle can easily be varied as desired and the blade or paddle may be held in the slot through suitable means, such as welding.

Figure 6:
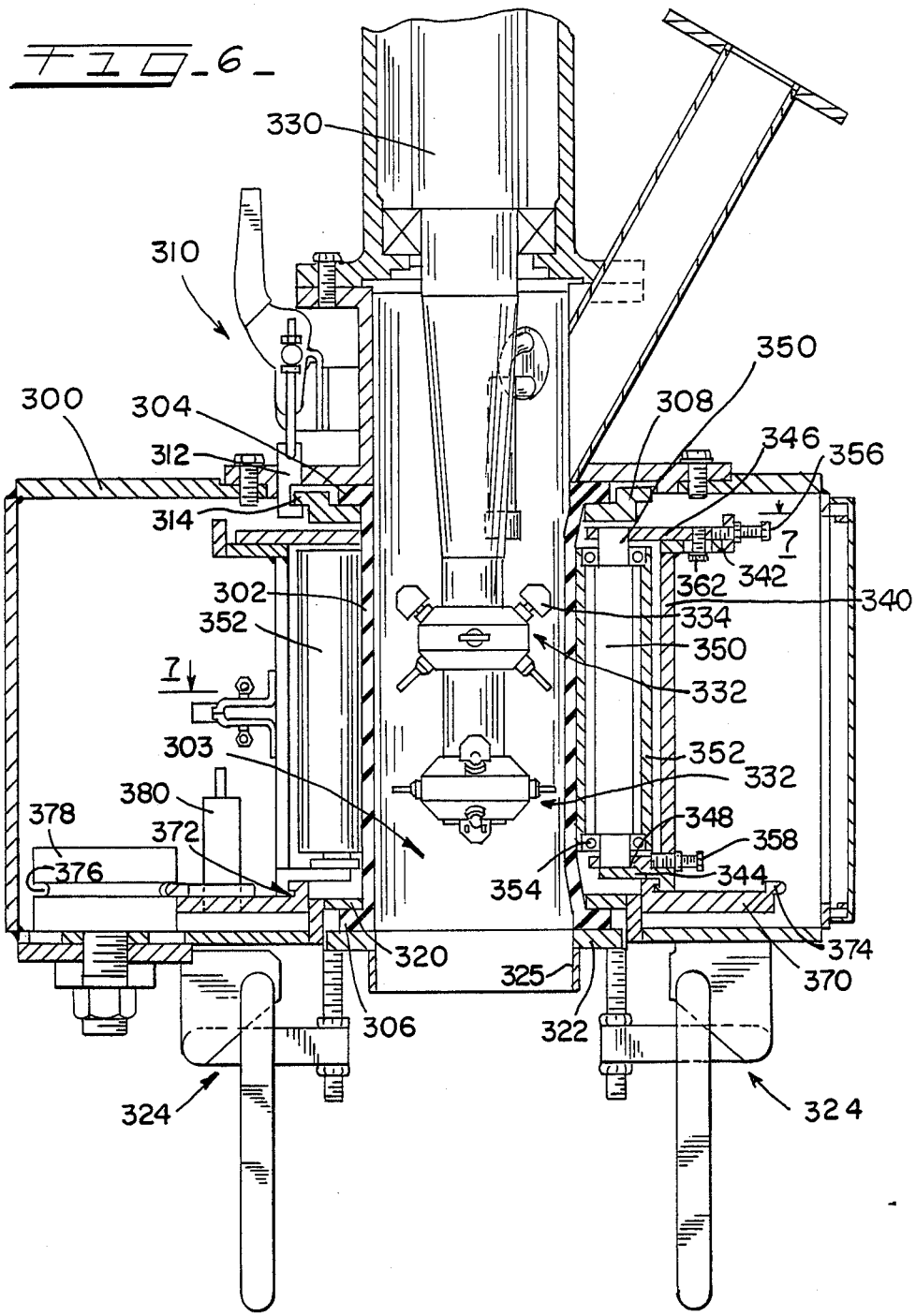
FIG. 6 is a cross-sectional view similar to FIG. 5 of a further modified form of a mixer.
Figure 7:
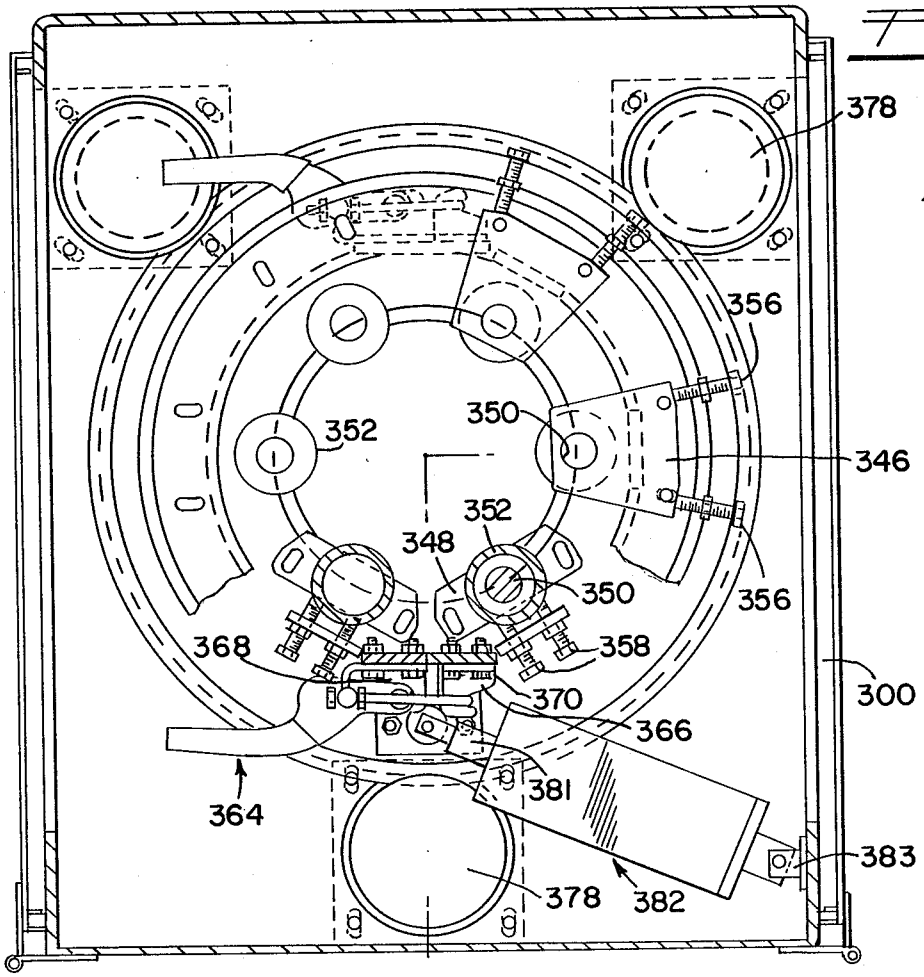
FIG. 7 is a cross-sectional view as viewed along line 7—7 of FIG. 6.

A still further slightly modified form of mixer is illustrated in FIGS. 6 and 7. In this embodiment, a housing 300 supports a flexible sleeve 302 that defines a mixing chamber 303 has upper and lower flanges 304 and 306 at opposite ends thereof. The upper flange 304 is clamped between the housing 300 and a clamping ring 308 by suitable clamping structures 310, the number being dependent upon the size and configuration of the unit. As illustrated in FIG. 6, the clamping member 310 has a clamping element 312 which has an inwardly opening slot for receiving an outward extension 314 on the member 308. The extension or ring 314 may be circular and have flattened tangential chord portions which may be aligned with the clamping elements for ease in assembly.

The lower flange 306 is gripped between a clamping element 320 formed on the housing 300 and a clamping ring 322 by a plurality of clamping members 324. The lower clamping ring 322 defines an outlet 325 for the mixing chamber.

In the embodiment illustrated in FIG. 6, the mixing shaft 330 has a plurality of blade holders 332 supported on the lower end thereof in the mixing chamber 303. Each blade holder supports a plurality of mixing blades 334 which may take any configuration, such as those described above.

The deforming means shown in FIGS. 6 and 7 consists of a substantially circular cage or ring 340 that has an outwardly directed flange 342 at its upper end and an inwardly directed flange 344 at its lower end. An upper support bracket 346 is adjustably secured to the upper flange 342 while a lower support bracket 348 is adjustably secured to the lower flange 344. Each pair of brackets 346 and 348 supports a shaft 350 in a fixed vertical orientation and each shaft supports a hollow circular deforming member 352 through suitable bearings 354. In this embodiment, the upper and lower brackets are independently adjustable on the cage 340 through suitable adjusting screws 356 and 358. The upper supporting adjusting screws 356, two being illustrated in FIG. 7, engage the outer edge of the generally trapezoidal bracket 346 while the lower adjusting screws 358 engage the outer periphery of lower brackets 348. The upper and lower brackets can be held in the adjusted positions through suitable bolts 362, only one being illustrated in the drawing.

The cage or ring 340 is preferably formed in two identical halves, each of which supports at least one circumferentially spaced deforming member 352 and the two halves are interconnected by clamp means 364. Each ring half has a bracket structure 366 and 368 secured thereto by bolts 370 so that the two halves can easily be interconnected through the manipulation of the clamp means 364.

In the embodiment illustrated in FIGS. 6 and 7, a slightly modified form of drive means for the cage 340 is shown. In this embodiment, the lower portion of the cage has a cam ring 370 secured thereto, which may be clamped by an interacting slot arrangement 372. The outer peripheral surface defines a cam ring 374 that is received into a groove 376 that is defined on a freely rotatable roller 378, three of which are equally circumferentially spaced and supported on the housing 300.

In the embodiment illustrated in FIGS. 6 and 7, the deforming means is designed to be reciprocated along a predetermined arc around the perimeter of the sleeve 302. Thus, the lower supporting ring 370 has an upwardly extending stub shaft 380 secured thereto, the upper end of which has a piston rod 381 of a fluid ram 382 secured thereto. The opposite end of the ram is pivoted on a bracket 383 on the housing 300, as clearly illustrated in FIG. 7.

Supplying pressurized fluid, such as air, to opposite ends of the fluid ram 382, will cause the cage 340 to be reciprocated along a predetermined arc around the sleeve 302 while being supported in concentric relation by the three circumferentially spaced rollers 378. Of course, the individual deforming members or rollers 352 can easily be adjusted to vary the amount of deformation that occurs through such reciprocating motion of the cage structure.

The cage structure of FIGS. 6 and 7 can be utilized in connection with drive means other than a reciprocating drive. This structure could, for example, employ a sprocket or other drive means located at some point along its periphery with a drive engaging this drive to continuously rotate the cage in one direction around the sleeve.

Figure 8:
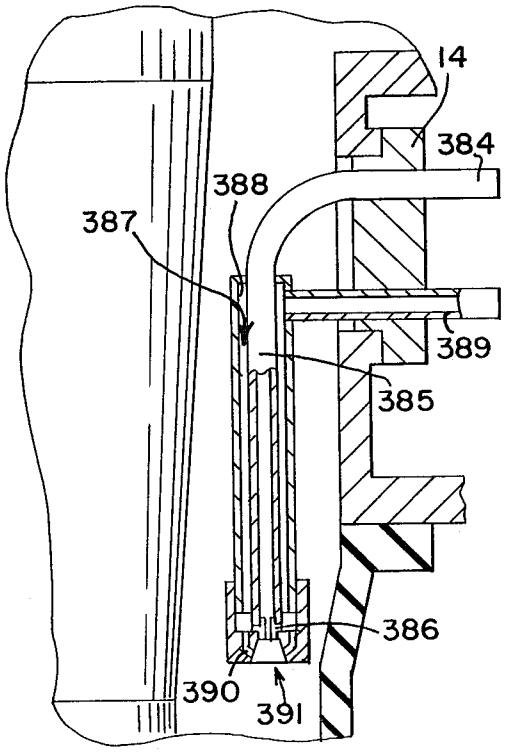
FIG. 8 is a fragmentary cross-sectional view showing the details of the liquid supply inlet for all embodiments.

FIG. 8 of the drawings discloses a specific exemplary type of nozzle structure that can be utilized for supplying the liquid into the mixing chamber in any of the embodiments previously described. Thus, a first liquid supply tube 384 extends through the housing, such as housing 14, and has a lower downwardly directed portion 385 terminating in a lower outlet opening that has a nozzle 386 received therein. An annular outer sleeve 387 surrounds the vertical portion 385 of the tube and defines an annular chamber 388 which is connected to a pressurized air source through a conduit 389. The lower end of the annular chamber 388 has ducts 390 leading to a mixing chamber 391 supported on the lower end of the tubes 385 and 387. Thus, the air flowing through the ducts 390 will thoroughly atomize the liquid flowing through the venturi nozzle 386 to provide an atomized mixture of liquid to the mixing chamber.

While only one liquid supply inlet has been shown in the drawings, it will be appreciated that any number of such inlets could be circumferentially spaced around the upper end of the mixing chamber and the number will depend upon the size of the chamber and the amount of liquid that is necessary.

Figure 9:
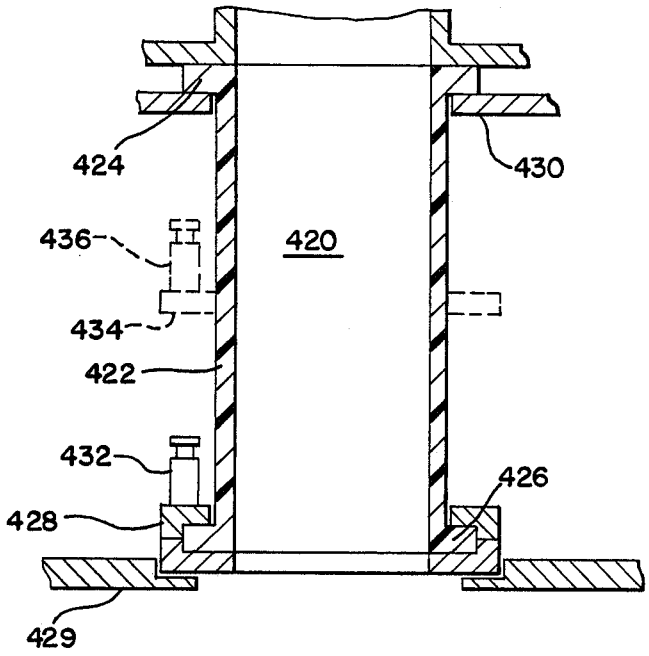
FIG. 9 is a cross-sectional view of the mixer sleeve illustrating alternative forms of deforming means; and, FIG. 10 is a cross-sectional view of a form of mixer sleeve including reinforcing means capable of controlling deformation.

FIG. 9 illustrates a modified form of the invention wherein the sleeve 422 is utilized for defining mixing chamber 420. Sleeve flanges 424 and 426 are secured in place by clamping means 428 and 430 in essentially the fashion described with reference to FIG. 2.

In order to achieve deformation of sleeve 422, a post 432 is mounted on clamping means 428 and a piston and cylinder combination or the like (not shown) is employed for reciprocating the clamping means 428 about the axis of the sleeve while the top clamping means remains stationary. The twisting action causes distortion of the sleeve material and thereby changes the diameter of the sleeve with the forces applied to the sleeve interior surface operating to dislodge encrusted material. The reciprocation of the arrangement of FIG. 9 can be activated by connecting a piston rod and ram to post 432 or 436, as described with reference to FIGS. 6 and 7. The rings 428 or 434 would then function in the manner of ring 370, shown in those Figures.

Alternatively, one or more intermediate rings 434 may be attached to sleeve 422 with post 436 serving as a means for attaching a reciprocating drive. In this instance, both the top and bottom clamping means are held stationary with the sleeve twisting occurring above and below ring 434.

It will also be appreciated that the specific construction and movement of the deforming means illustrated in the respective embodiments could be used interchangeably in the remaining embodiments disclosed herein. Likewise, the specific retaining means for the respective blades on the holders could likewise be interchangeable and any one of the three specific embodiments illustrated could be used in the commercial structure. Also, the adjustment for the deforming rollers shown in FIGS. 6 and 7 could be incorporated into the other illustrated embodiments.

While specific embodiments have been illustrated and described, numerous modifications come to mind without significantly departing from the spirit of the invention and the scope of protection is only limited by the scope of the accompanying claims.

We claim:

1. A mixer comprising a housing having a flexible, substantially circular mixing sleeve defining inner and outer surfaces, said sleeve being releasably supported therein in a substantially vertical orientation and defining a mixing chamber, an upper end defined by said mixing chamber, means for supplying solid particulate material and separate means for supplying liquid, supply inlet means adjacent said upper end of said mixing chamber for said particulate material and said liquid whereby said material and said liquid are mixed in said mixing chamber, a mixing shaft supported for rotation about a fixed axis of said housing and extending into said mixing chamber, said mixing shaft having a plurality of mixing blades circumferentially and radially spaced thereon, an arcuate support member at least partially surrounding said mixing sleeve and having a plurality of vertically extending deforming members rotatably supported thereon and engaging said outer sleeve surface; and drive means producing relative movement between said support member and said mixing sleeve and producing localized deformation of said sleeve to break up deposits of the material being mixed which may have collected on said inner surface of said sleeve.

2. A mixer as defined in claim 1, comprising an upper end for said sleeve, said housing having clamp means for gripping an upper end of said mixing sleeve so that said sleeve is suspended in said housing.

3. A mixer as defined in claim 2, including means for gripping the lower end of said sleeve.

4. A mixer as defined in claim 2, further including a lower end for said sleeve, guide means on said lower end of said sleeve preventing rotation of said sleeve on said housing and accommodating axial movement thereof.

5. A mixer as defined in claim 1, in which said support means includes a cage surrounding said sleeve with a plurality of circumferentially-spaced, axially-extending rollers freely rotatable on said cage, said rollers comprising said deforming means.

6. A mixer as defined in claim 5, further including ring means extending from said cage and roller guide means on said housing guiding said cage and maintaining a centered relation between said cage and said sleeve.

7. A mixer as defined in claim 6, in which said ring means and said roller guide means are positioned adjacent said upper end of said sleeve to suspend said cage around said sleeve.

8. A mixer as defined in claim 6, in which said ring means includes a cam adjacent a lower portion of said sleeve with said roller guide means including circumferentially-spaced rollers on said housing having grooves receiving said cam to support said cage around said sleeve.

9. A mixer as defined in claims 5, 6, 7 or 8, in which said drive means includes a drive member for reciprocating said cage about a fixed vertical axis substantially coincident with said sleeve.

10. A mixer as defined in claims 5, 6, 7 or 8, further including adjusting means for independently adjusting the position of each roller with respect to said cage.

11. A mixer as defined in claims 5, 6, 7 or 8, in which said drive means includes a drive gear on said housing engaging said cage to rotate said cage about said sleeve.

12. A mixer as defined in claim 1, in which said material supply inlet includes a feed tube extending substantially perpendicular to said sleeve and having a material transporting means with agitating paddles rotatable therein to provide a substantially uniform particulate material supply to said mixing chamber.

13. A mixer as defined in claim 12, in which said material supply inlet includes a second feed tube upwardly-inclined with respect to said sleeve for gravity feeding material into said mixing chamber.

14. A mixer as defined in claim 1, further including a plurality of blade holders axially spaced on said shaft, each having a plurality of angularly-related circumferential surfaces thereon with each surface having a plurality of sockets defined therein, and a plurality of blades each having a circular base and a flat mixing blade extending therefrom with said bases received into respective sockets and being rotatable therein, and releasable retaining means for maintaining said bases in adjusted positions in said sockets.

15. A mixer as defined in claim 14, in which said releasable retaining means includes a hollow threaded nut surrounding a base for holding said base in said socket.

16. A mixer as defined in claim 15, in which each base has a circumferential groove therein with a split ring received into said groove, said ring being engageable by said threaded nut to press and hold said base in angularly-adjusted positions in said socket.

17. A mixer as defined in claim 15, in which said threaded nut is threaded on said base and said base is threaded into said socket with said nut having an external locking surface engaging said holder to lock said mixing blade in angular and radial adjusted positions in said socket.

18. A mixer as defined in claim 14, in which each of said bases has an annular groove thereon and is rotatable in a socket with said retaining means including a set screw on said holder having a free end received into said groove to frictionally retain said base in said socket.

19. A mixer as defined in claim 1, further including a hollow support member telescoped on said mixing shaft and having a plurality of axially spaced blade holders formed integrally thereon, each blade holder having a first circumferential supporting surface formed on the periphery thereof and second and third inwardly inclined supporting surfaces on opposite ends of said first circumferential supporting surface, each supporting surface having a plurality of circumferentially spaced bores therein, and a mixing blade received into each of said bores with a retaining means for supporting each mixing blade in angularly adjusted positions in said bases.

20. A mixer as defined in claim 19, in which each retaining means includes a hollow threaded nut surrounding a base and received into a bore to lock the mixing blades in adjusted positions in the bases.

21. A mixer comprising an elongated cylindrical sleeve of flexible material defining a mixing chamber having a substantially vertical axis with a mixing material inlet and a liquid supply inlet above said mixing chamber, and a mixing shaft extending from above said sleeve into said mixing chamber and having a drive coupled thereto with a plurality of axially-spaced blade holders thereon each supporting a plurality of mixing blades, each blade holder including a plurality of circumferentially-spaced supporting surfaces angularly related to each other in the axial direction and each having a plurality of circumferentially-spaced support bores extending inwardly therefrom, a substantially circular base defined by each mixing blade, each mixing blade also defining a flattened blade portion formed integrally therewith with said base being received into a supporting bore, and releasable retaining means for retaining said mixing blades in infinity variable angular positions with respect to said bores.

22. A mixer as defined in claim 21, in which each bore is internally threaded and has an outwardly-tapered unthreaded portion adjacent said supporting surface and each base is externally threaded with said retaining means including a lock nut threaded onto said base and having an external taper corresponding to and received into said unthreaded portion of said bore so that said blade can be angularly and radially positioned with respect to said bore.

23. A mixer as defined in claim 21, in which each base has an annular peripheral groove and said retaining means includes a set screw threaded into an opening in said holder and having an inner end received into said groove to frictionally hold said base in said bore.

24. A mixer as defined in claim 21, in which said retaining means includes an externally threaded lock nut threadedly received into said bore and surrounding said base and a split ring in said bore surrounding an inner end of said base and compressed by said lock nut to frictionally retain said base in said bore.

25. A mixer as defined in claim 22, 23 or 24, in which said mixing shaft defines a central core with an elongated integral member having an opening receiving said core and having at least one enlarged diameter external portion defining blade holders, each blade holder having a first peripheral support surface axially aligned with said vertical axis and second and third support surfaces inwardly inclined at opposite ends of said first peripheral support surface.

26. A mixer as defined in claims 22, 23 or 24, in which each blade holder includes a circular hollow member supported on said shaft and having an intermediate first peripheral support surface and second and third inwardly-inclined support surfaces at an opposite ends thereof, and a spacer sleeve on said shaft between said adjacent pair of blade holders.

27. A mixer as defined in claims 22, 23 or 24, further including means for suspending said sleeve at its upper end and deforming means surrounding and extending axially of said sleeve, said deforming means including moving means for moving said deforming means about an axis for said sleeve to deflect said sleeve inwardly.

28. A mixing apparatus having a mixing chamber with a mixing shaft rotatable in said housing and having a mixing member supported thereon, said mixing member including a hollow member releasably retained in said shaft, said hollow member having axially-spaced enlarged diameter portions defining a plurality of integrally-formed, axially-spaced blade holders, each blade holder including a first circumferential support surface having an axis coincident with said shaft, opposite ends defined by said support surface, and second and third inclined support surfaces on said opposite ends of said first support surface, each of said support surfaces having a plurality of circumferentially-spaced threaded support bores therein, a blade supported in each bore with each blade including a base received into said bore and having an integral flat mixing blade extending therefrom, and releasable lock means received into each bore to lock said mixing blades in angularly-adjusted positions in said bores.

29. A mixing apparatus as defined in claim 28, in which each base is externally threaded and received into a threaded bore and each lock means includes a hollow internally-threaded lock nut received on said base and having a locking surface engaging a corresponding locking surface in said bore.

30. A mixing apparatus as defined in claim 28, in which each locking means includes an externally threaded lock nut surrounding a base and threaded into said bore and a locking ring received into said bore around said base to frictionally lock the base in the bore.

31. A mixer a defined in claims 4, 21, or 28, including compressible sealing means interposed between engaging part surfaces of blade holder means to prevent penetration of material being treated into crevices defined by the blade holder means.

32. A mixer comprising a housing having a flexible, substantially circular mixing sleeve defining inner and outer surfaces, said sleeve being supported therein in a substantially vertical orientation and defining a mixing chamber, an upper end defined by said mixing chamber, means for supplying solid particulate material and separate means for supplying liquid, supply inlet means adjacent said upper end of said mixing chamber for receiving said particulate material and said liquid and for feeding said material and said liquid into said mixing chamber, a mixing shaft supported for rotation about a fixed axis of said housing and extending into said mixing chamber, said mixing shaft having a plurality of mixing blades circumferentially and radially spaced thereon, an arcuate support member at least partially surrounding said mixing sleeve, a plurality of vertically extending deforming members supported on said support member, said deforming members engaging said outer sleeve surface; and drive means producing relative movement between said support member and said mixing sleeve for moving said deforming members relative to said sleeve and for producing localized deformation of said sleeve to break up deposits of the material being mixed which may have collected on said inner surface of said sleeve.

* * * * *